United States Patent [19]

Bukovitz et al.

[11] Patent Number: 4,605,078

[45] Date of Patent: Aug. 12, 1986

[54] CARRIAGE FEED SYSTEM

[75] Inventors: Ronald F. Bukovitz, Richardson, Tex.; Walter C. Vliet, Landing, N.J.

[73] Assignee: Ingersoll-Rand Company, Woodcliff Lake, N.J.

[21] Appl. No.: 617,922

[22] Filed: Jun. 6, 1984

[51] Int. Cl.[4] ..... E21B 19/08

[52] U.S. Cl. ..... 175/162; 175/113; 175/122

[58] Field of Search ..... 175/162, 113, 122, 203; 166/385

[56] References Cited

FOREIGN PATENT DOCUMENTS

| | | | |
|---|---|---|---|
| 1176079 | 8/1964 | Fed. Rep. of Germany | 175/162 |
| 941280 | 11/1963 | United Kingdom | 175/162 |
| 1204864 | 9/1970 | United Kingdom | 175/162 |

*Primary Examiner*—Stephen J. Novosad
*Assistant Examiner*—Thuy M. Bui
*Attorney, Agent, or Firm*—Walter C. Vliet

[57] ABSTRACT

Disclosed is a new carriage feed system which utilizes in the preferred embodiment a single double rod feed cylinder having its rod ends mounted to the top bridge and base of the tower respectively.

The cylinder is hydraulically fed at the ends of the rod. A sheave carrier is mounted at each end of the barrel of the cylinder. The cylinder barrel forming the structure for support of the carriers which are also guided in the tower structure for linear movement along the tower. The cable reeving for the system is disposed about sheaves on the carrier and anchored at the tower mid-point. Suspended from the cable and guided on the tower is a drill head which performs the usual drilling functions. The system is fully balanced with regard to loads in the cables and about the cylinder to minimize offset stress. In addition, all draw down forces are taken in tension in the cylinder rods.

7 Claims, 6 Drawing Figures

CARRIAGE FEED SYSTEM

BACKGROUND OF THE INVENTION

In a large marjority of rotary drilling machines used in applications such as water well, shallow oil and gas, blast hole and exploration drilling, the top and bottom of the derrick or mast or tower is used to support the loading of actual drilling and extraction operations.

Loading is induced at the tower or mast top and bottom by transmitting forces generated by a hydraulic cylinder through a cable or chain arrangement over sheaves or sprockets in the top and bottom to direct the force to raise or lower the drilling head. This loading is transferred to the mast structure via the crown sheaves or sprockets at the top and bottom sheaves or sprockets and requires that the mast be designed to accept loads two or three times the actual rotary head loads.

OBJECT OF THE INVENTION

The object of the invention is to provide a feed system which is inexpensive, easy to assemble and minimizes tower loading. The described system eliminates the compressive and tensile loading in the upper half of the mast and reduces the loading in the lower half to a level equal to the rotary head load.

A further object of the invention is to produce a feed system which is subjected to balanced loading in such a way as to prevent offset loads and stresses in the structures.

Yet, a further object is to produce a system which is hydraulically balanced and could produce equal forces in both draw down or drilling, and pull back or extraction operations.

Yet, a further object is to provide a hydraulically simplified system wherein equal areas are exposed in pull down and draw back operations, thereby permitting simplified hydraulic control for a hydrostatic system.

Yet, a further object of the invention is to eliminate draw down loads in the top portion of the tower and further limit draw down loads in the lower portion of the tower to that equal to the draw down load on the drill string driver or drilling head.

These and other objects are obtained in a carriage feed system comprising: an earth and rock drilling machine having a tower, a drilling head, a first guide means for guiding and drilling head for vertical movement along a preferred path with respect to the tower and drill means attached to the drilling head for drilling holes, feed means for effecting the vertical movement of the drilling head comprising: (a) a double rodded hydraulic cylinder extending substantially the length of the tower; the cylinder having a cylinder barrel which traverses the cylinder rods from a position near the bottom of the tower to a position near the top of the tower; (b) an upper wheel and a lower wheel for rotation being attached to the said cylinder barrel, each wheel having a second guide means formed in the periphery thereof for engaging and guiding a flexible segment, the upper and lower wheels arranged so that their respective guide means are coplanar; (c) at least one flexible segment joined to form the continuous unitary loop disposed about a portion of the periphery of the upper and lower wheels and in guiding engagement with the second guide means thereof; (d) the anchor means located approximately midway on the tower for rendering a first portion of the at least one flexible segment stationary and inmovable with respect to the tower; and (e) Coupling means for attaching a second portion of the at least one flexible segment to the drilling head.

DESCRIPTION OF THE PREFERRED EMBODIMENT

Figure 1:
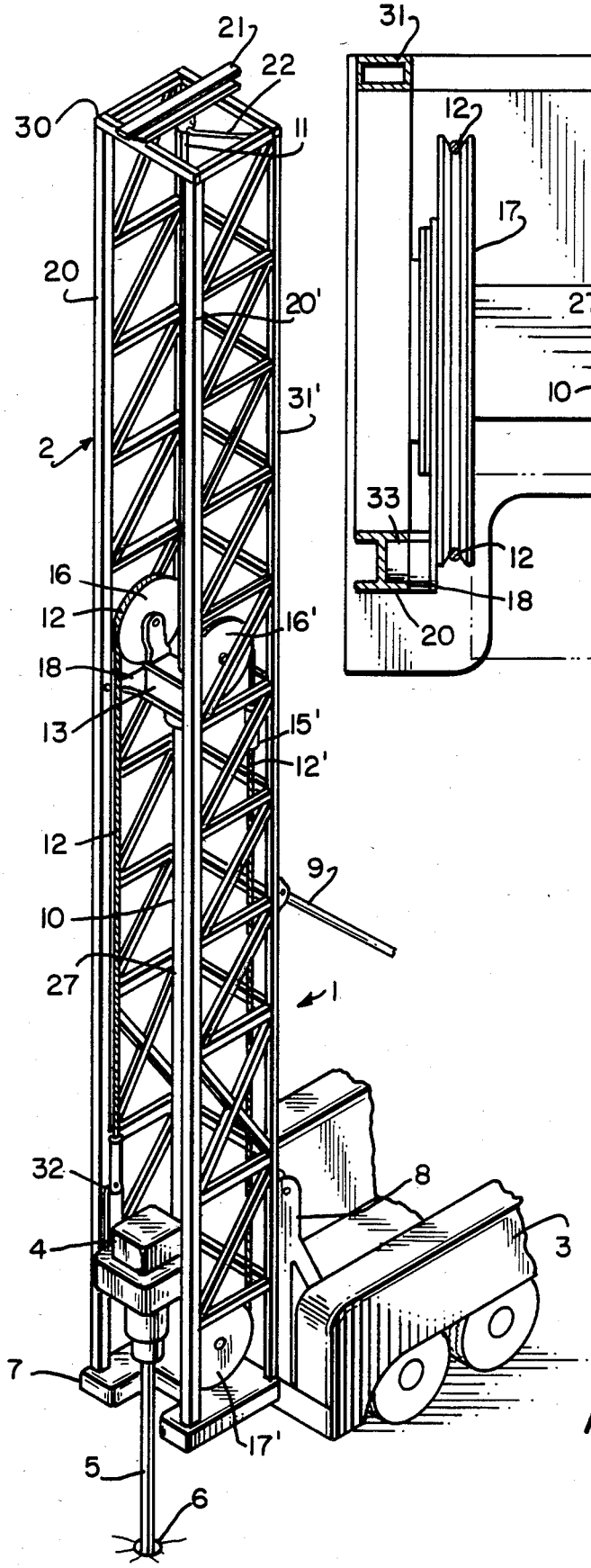
FIG. 1 is a partial perspective view of a rock and earth drilling machine showing the preferred embodiment of this invention.

Referring to FIG. 1, a drill rig or drilling machine is shown and generally designated by reference numeral 1. The drilling rig is comprised of a drill tower 2, sometimes referred to as a derrick or mast. For purposes of the preferred embodiment, the tower 2 is shown mounted on a mobile rig 3 which may comprise a truck body or crawler tractor or the like. It should also be understood that the tower may be ground supported. The tower is shown attached to the mobile rig 3 by means of a tower support 8. It should be understood that the tower may be carried by the mobile rig in the horizontal position and raised to the vertical position as shown by means of a tower lift cylinder 9 which is partially shown. A drill head 4 is shown attached to the tower and mounted in guides such that the drill head may be linearly traversed along the length of the tower from top to bottom as shown in FIG. 1.

Attached to the drill head and rotated thereby is a drill pipe 5, sometimes referred to a drill string which is rotated and forced down into the bore hole 6 to accomplish earth or rock boring. The bottom of the tower is designated as tower base 7. The top of the tower is generally referred to as the crown 30.

To this point the structure that has been described is generally well known in the industry and typical of mobile drill rigs. The present invention relates to the mechanism for transporting the drill head traversly along the length of the tower. The mechanism can best be described by reference to FIGS. 1 and 2. The drilling rig tower 2 may be of generally conventional construction such as that shown using standard structural steel for the rear cord 31 and 31' and the cross bracing, and a structural shape such as a wide flange I beam or H beam 20 and 20' for the front cord which serves as a guide for the drill head and also the feed system as will be later described.

A double rod, rod end fed cylinder 10 having a barrel 27 with a cylinder rod 11 extending to the crown 30 of the tower and a cylinder rod 11' extending to a support near the base 7 of the tower is shown. The double rod feed cylinder receives hydraulic fluid from fittings at each end of the cylinder rod (shown as hydraulic fluid inlet 22 near the crown 30 and hydraulic fluid inlet 22' shown in FIG. 2 near the base of the tower). Mounted on either end of the cylinder barrel 27 is a wheel yoke. The upper wheel yoke is designated by reference numeral 13; the lower wheel yoke by the reference numeral 14. Each wheel yoke mounts two wheels, sheaves or sprockets. The wheels are mounted in appropriate saddles for rotation and are located as to present a balanced configuration.

Referring to FIG. 1, the upper sheaves or sprockets have been designated with reference numerals 16 and 16'. The lower wheels (sheaves or sprockets) have been designated with reference numeral 17 and 17'. A cable 12, 12' is shown looped about the upper and lower sheaves 16, 17 and 16' and 17' respectively. The cable is anchored at approximately the midpoint of the tower by means of an anchor 15, 15'. The cable is connected to the drill head carriers 32 and 32' (best seen in FIGS. 2 and 3). The drill head 4 is supported on the carriers 32, 32' and as the carriers are transported by means of the cables 12, 12', the drill head is also transported in a linear direction along the axis of the tower.

Figure 2A:
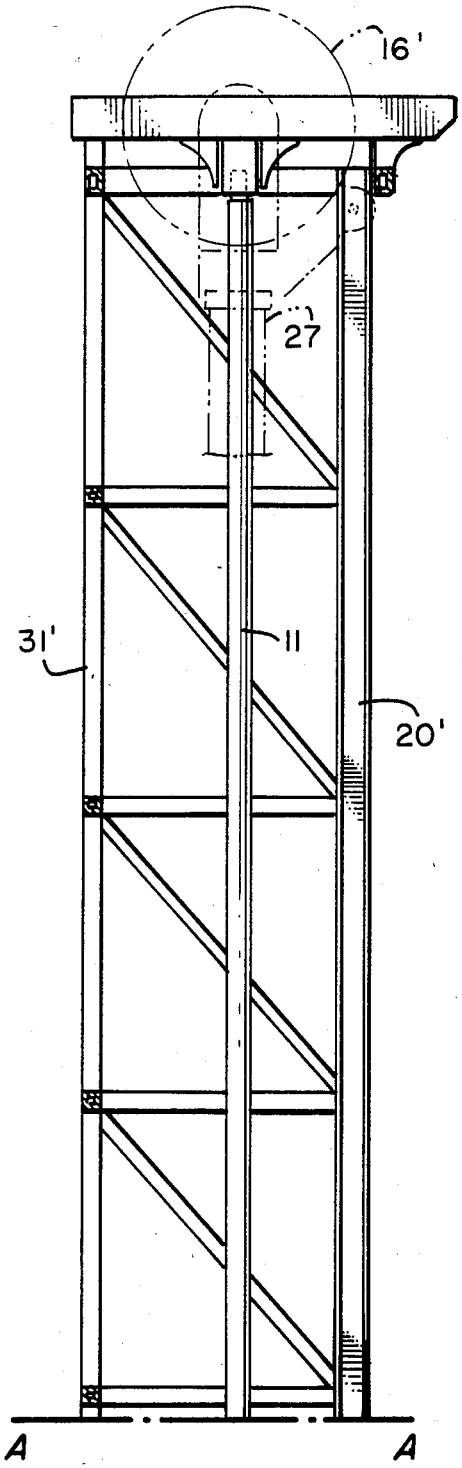
FIG. 2*a* is a continuation FIG. 2 to the top half of tower.
Figure 2:
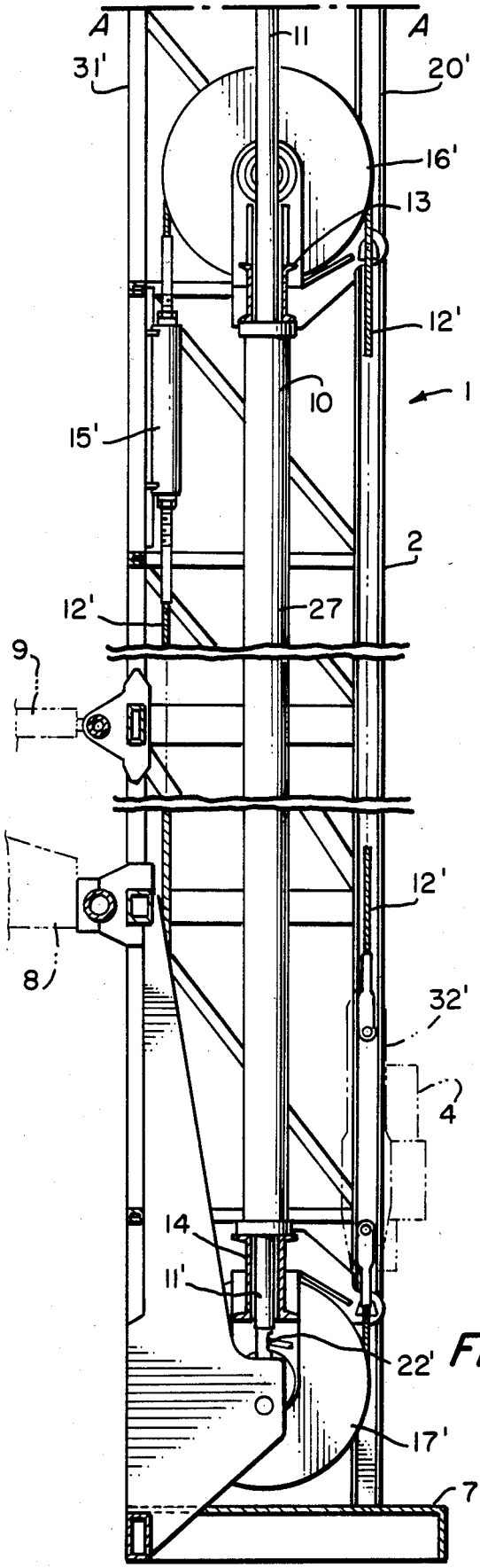
FIG. 2 is a side elevation of the lower half of the tower or mast portion of the drilling machine showing the unique feed mechanism.
Figure 3:
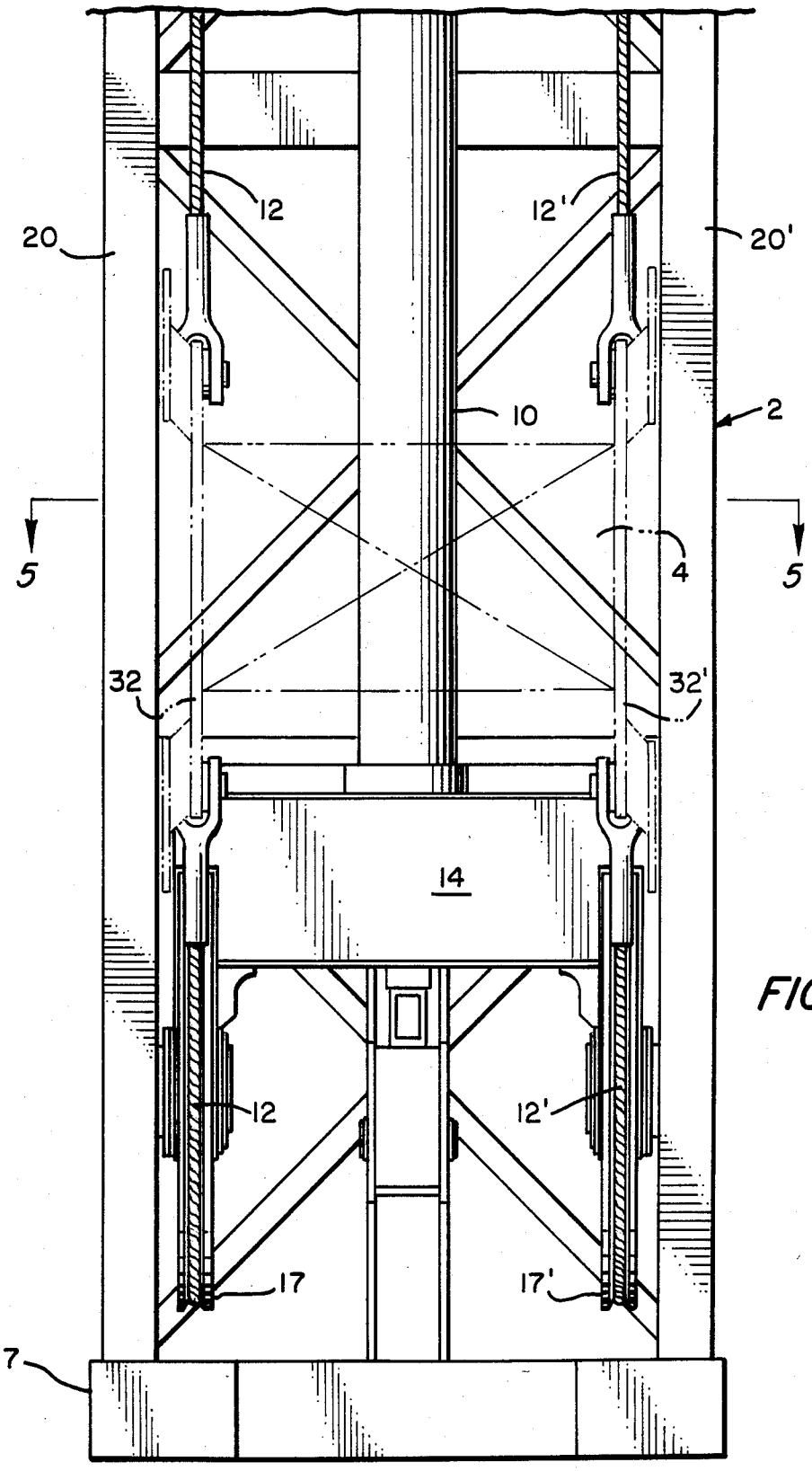
FIG. 3 is a partial front elevation in detail showing the drill head mounting carriage and the lower portion of the feed cylinder.

It should be understood that as hydraulic cylinder 10 is pressurized with hydraulic fluid, the cylinder barrel 27 will transport axially along the cylinder rod 11. As shown in FIG. 2, the cylinder barrel 27 is in its lower most position with the drill head 4 at its lower most position on the tower. FIG. 2*a* shows the cylinder barrel 27 in its upper most position (shown in phanthom). In this case, the drill head 4 (not shown) is at its upper most position on the tower. It may be appreciated by one skilled in the art that the drill head moves at twice the speed of the cylinder barrel in rising from the bottom to the top of the tower and travels twice the distance.

It may be also appreciated by one skilled in the art that if cylinder rod 11 is only guidingly supported in the crown 30, that is, not attached to transmit a vertical load, all of the forces required to transmit the drill head both up and down are eliminated from the top of the tower. If the cylinder rod 11 is ridgidly supported in the top of the tower, the tower must share compressive forces with the cylinder rod 11'. Some combination of the two extremes may be desirable and may be accomplished by elastically supporting the upper cylinder rod. (For example, by means of an adjustable compression spring connected between the cylinder rod and the tower). In this manner the forces may be distributed as desired between the cylinder rod and the tower.

Figure 5:
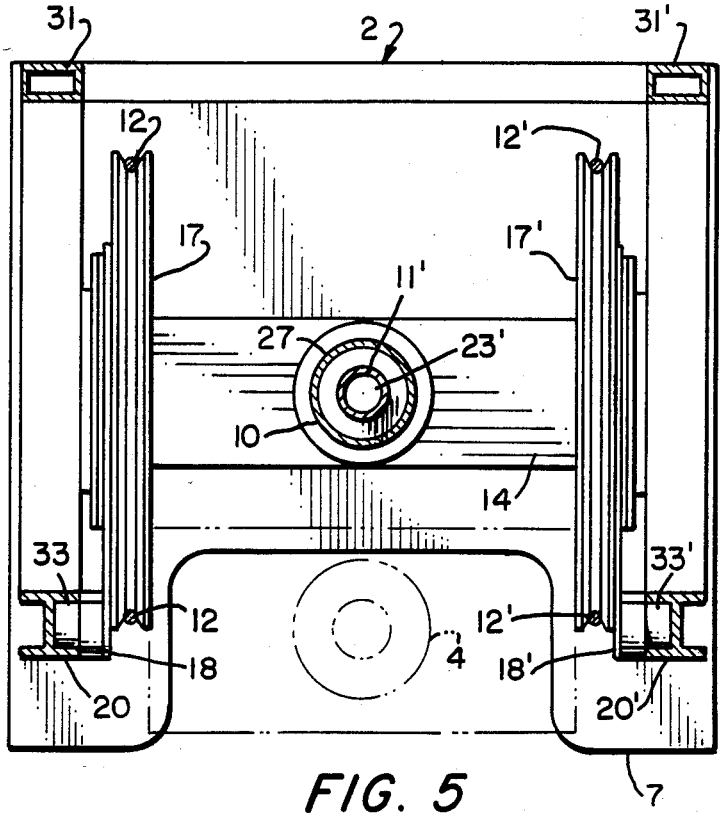
FIG. 5 is a plan section view of the tower and feed cylinder taken at section 5—5 of FIG. 3.

As shown in FIG. 5, the cylinder barrel 27 is guidingly supported by the front guide channel by means of cylinder guides 18 and 18'. The cylinder guides give the cylinder barrel and wheel yoke support in the transverse direction relative to the tower and permit the tower assembly to be tilted to the horizontal position without undue stress placed on the cylinder rods. The cylinder guides 18 and 18' may be in the form of forward projecting gussets having cam followers 33, 33' which engage the guide channel 20, 20' respectively. These guides allow the cylinder barrel to translate axially along the tower but prevent transverse movement.

The balanced construction of the preferred embodiment (best seen in FIGS. 2 and 5) minimizes offset forces on the cylinder and cylinder rod as well as the tower and thereby permit further economies of construction. This further eliminates problems experienced in the prior art whereby multiple hydraulic cylinders are used and the forces generated to transport the drill head 4 may be in the order of two to three times the actual head loads. Balancing problems with regard to the hydraulic fluid flow to the cylinders are also eliminated with this construction.

Figure 4:
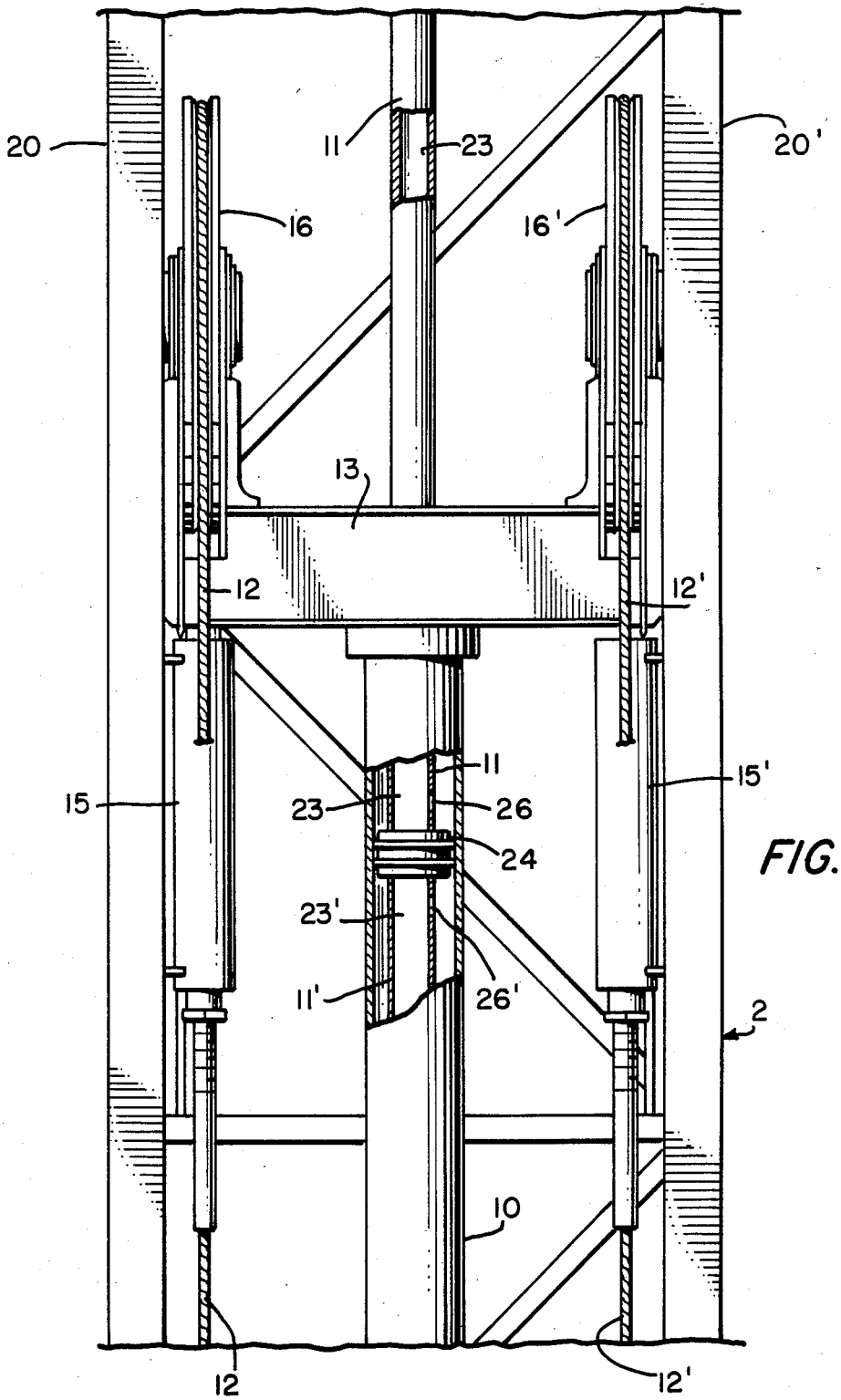
FIG. 4 is a partial front elevation partially sectioned in detail showing the upper portion of the cylinder and internal details.

Further advantage of the construction as shown in FIG. 4 resides in the equal cylinder areas in both directions. The upper cylinder rod 11 and the lower cylinder rod 11' are of the same diameter and are connected to a common cylinder piston 24. Hydraulic fluid is fed to the cylinder through the rod ends and transported through the hollow rods in upper cylinder rod bore 23 and lower cylinder rod bore 23'. Hydraulic fluid entering through the cylinder rod bore 23, 23' is directed into the hydraulic cylinder chambers by means of ports 26, 26' in the cylinder rods.

As can be appreciated by one skilled in the art, pressurizing the upper cylinder rod results in the cylinder barrel 27 rising and thereby carrying along with it the yokes. This in turn causes the drill head 4 to be raised by the cables 12, 12'. Conversly, pressurizing the lower cylinder rod with hydraulic fluid results in the cylinder barrel 27 being displaced towards the bottom of the tower and hence carrying with it through the cable reeving the drill head 4 to the bottom of the tower. The equal hydraulic area permits simplified hydraulic valving and further by connecting the two rod ends to each other through a common valve permit a degree of free floating of the drill head which is often desirable. Blocking the flow between the top and bottom provides a simplified brake or locking means for the drill head in a particular position. Equal forces are provided possible in both the raising and lowering of the drill head.

Having described my invention in terms of a preferred embodiment, numerous modifications and variations will now become obvious to one skilled in the art. We, therefore, do not wish to be limited in the scope of our invention except as claimed.

We claim:

1. In an earth and rock drilling machine having a tower, a drilling head, a first guide means for guiding said drilling head for translation along a preferred path with respect to said tower and drill means attached to said drilling head for drilling holes, feed means for effecting said translation of said drilling head comprising:

(a) a double rodded hydraulic cylinder having two cylinder rods, said cylinder extending substantially the length of the tower and having a cylinder barrel which traverses said cylinder rods from a position near the bottom of the tower to a position near the top of the tower;

(b) an upper wheel and a lower wheel for rotation being attached to said cylinder barrel, each wheel having a second guide means formed in the periphery thereof for engaging and guiding a flexible segment, said upper and lower wheels arranged so that their respective second guide means are coplanar;

(c) at least one flexible segment joined to form the continuous unitary loop disposed about a portion of the periphery of said upper and lower wheels and in guiding engagement with said second guide means thereof;

(d) an anchor means located approximately midway on said tower for rendering a first portion of said at least one flexible segment stationary and immovable with respect to said tower; and (e) coupling means for attaching a second portion of said at least one flexible segment to said drilling head.

2. An earth and rock drilling machine according to claim 1 wherein said double rodded hydraulic cylinder is fed hydraulic fluid for actuation of said cylinder at each of its rod ends.

3. An earth and rock drilling machine according to claim 1 wherein said cylinder rods are of equal diameter, each of said cylinder rods being attached to a cylinder piston within said cylinder barrel and extending opposite therefrom through a cylinder head at each end of said cylinder barrel along a common axis to respective ends of said tower and said cylinder barrel is of constant diameter.

4. An earth and rock drilling machine according to claim 3 wherein one of said cylinder rods is attached to said tower near its bottom end and the other of said cylinder rod is guidingly supported in said tower near its top end.

5. An earth and rock drilling machine according to claim 1 wherein the cylinder rods are of equal diameter. whereby providing a double-ended hydraulic cylinder of equal hydraulic displacement.

6. An earth and rock drilling machine according to claim 1 wherein said cylinder barrel is provided with two upper wheels and two lower wheels at each end of said cylinder and each of said upper and said lower wheels are provided with a flexible segment joined to form a continuous unitary loop each with an anchor means located approximately midway on said tower thereby forming a balanced structure which eliminates offset loads on said hydraulic cylinder.

7. An earth and rock drilling machine according to claim 1 wherein said drilling head is guidingly supported in a track means of said tower.

* * * * *